US005960608A

United States Patent [19]

Ohtonen

[11] Patent Number: 5,960,608

[45] Date of Patent: Oct. 5, 1999

[54] METHOD AND APPARATUS FOR PLACING INNER HEADERS ONTO THE ENDS OF PAPER ROLLS

[75] Inventor: Aimo Ohtonen, Hollola, Finland

[73] Assignee: Valmet Corporation, Helsinki, Finland

[21] Appl. No.: 08/972,165

[22] Filed: Nov. 17, 1997

[30] Foreign Application Priority Data

Nov. 18, 1996 [FI] Finland ..... 964614

[51] Int. Cl.[6] ..... B65B 61/00

[52] U.S. Cl. ..... 53/415; 53/136.2

[58] Field of Search ..... 53/135.1, 136.1, 53/136.2, 415, 157, 284, 474; 493/102

[56] References Cited

U.S. PATENT DOCUMENTS

| | | | |
|---|---|---|---|
| 4,679,376 | 7/1987 | Ekblom | 53/211 X |
| 4,744,198 | 5/1988 | Hood et al. | 53/415 |
| 4,840,008 | 6/1989 | Hood et al. | 53/136.2 |
| 4,964,260 | 10/1990 | Focke et al. | 53/157 X |
| 5,533,321 | 7/1996 | Hooper et al. | 53/136.2 X |

FOREIGN PATENT DOCUMENTS 873601 2/1988 Finland .

*Primary Examiner*—Linda Johnson

*Attorney, Agent, or Firm*—Cohen, Pontani, Lieberman & Pavane

[57] ABSTRACT

A method and apparatus for placing headers onto the ends of paper or paperboard rolls by inserting the headers into the tubular cavity formed by the overlapping rim of the roll wrapper to the roll end. The roll to be packaged is transferred to the header inserter station, a header of desired type for the roll is fetched from a header support shelf and delivered to a header inserter grabber of a header inserter assembly waiting in its delivery position. Next, the header is transferred by movement of the header inserter grabber into the tube formed by the wrapper overlap, and subsequently, the header is transferred against the end of the roll. The header is transferred into the wrapper tube by means of rotating the header inserter grabber about a shaft, which is offset from the transfer path of the roll and is aligned orthogonal to the longitudinal axis of the roll. The header is made to advance into the wrapper tube in a tilted position so that the edge of the header situated closer to the shaft enters the wrapper tube before the entry of the trailing edge of the header into the same.

18 Claims, 4 Drawing Sheets

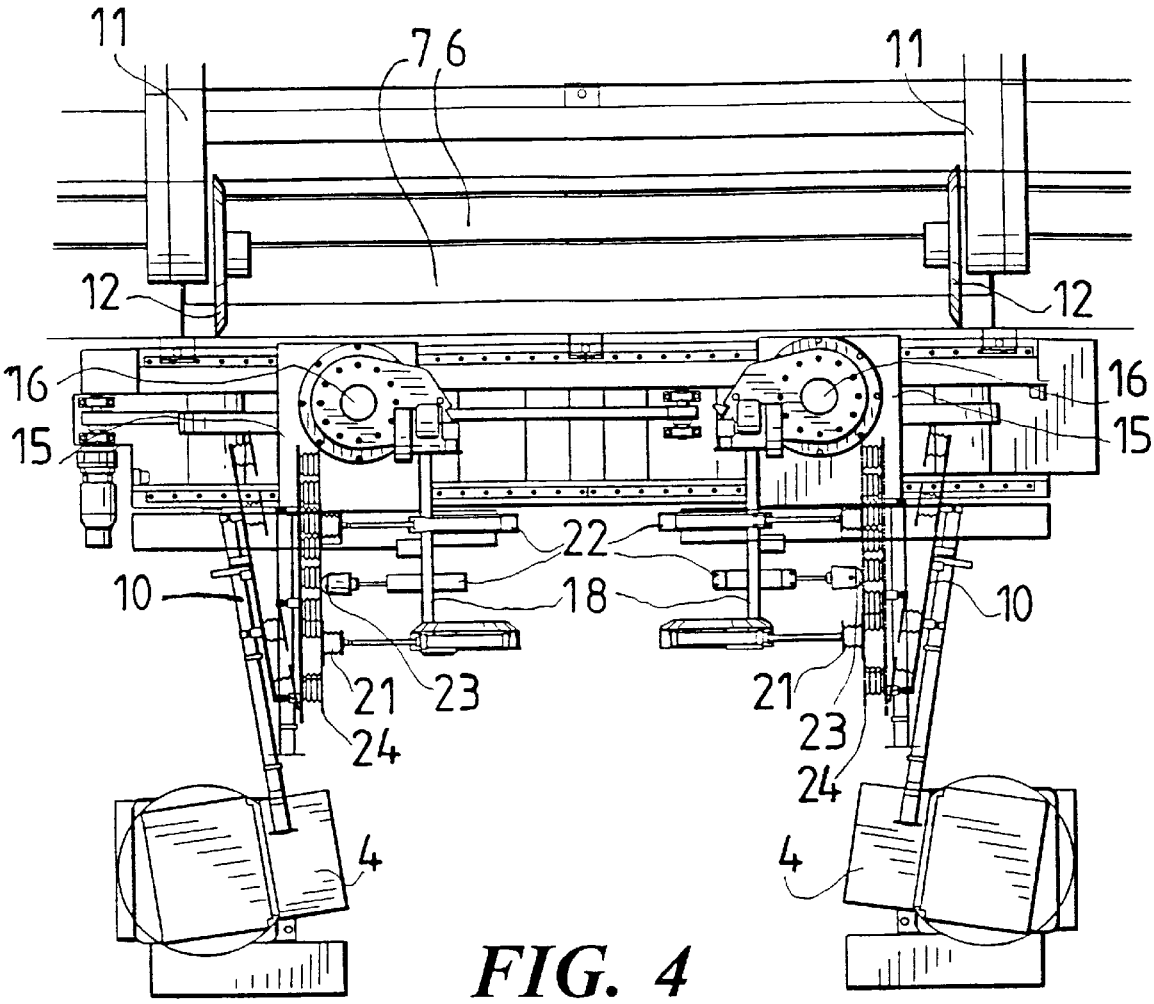
FIG. 4
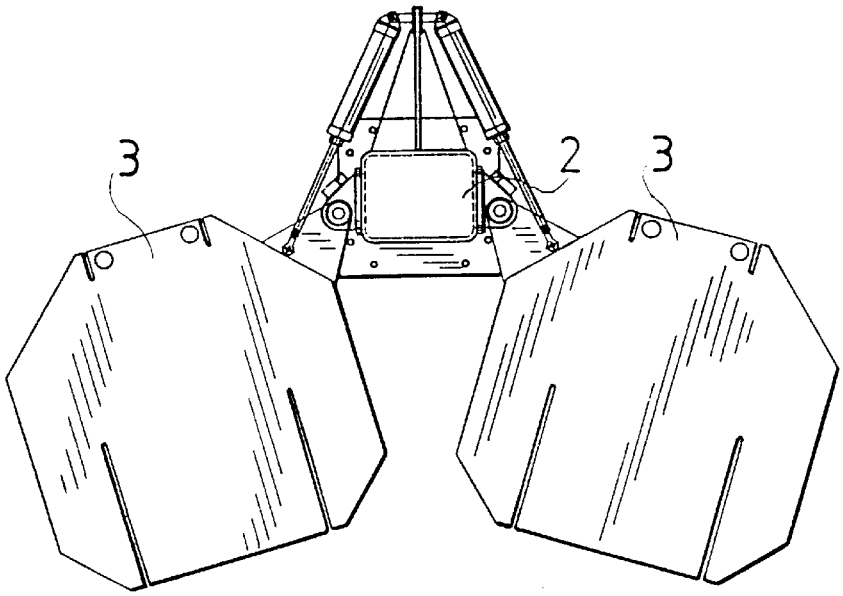

METHOD AND APPARATUS FOR PLACING INNER HEADERS ONTO THE ENDS OF PAPER ROLLS

FIELD OF THE INVENTION

The present invention relates to a method and apparatus for placing headers to the ends of paper and paperboard rolls in a packaging system performing the roll packaging by first placing a wrapper about the rolls and then inserting the inner headers into the tubular cavities formed by the wrapper overlap at the roll ends.

BACKGROUND OF THE INVENTION

Conventionally, paper rolls are packaged by first placing the inner headers onto the roll ends, followed by enveloping the roll in a desired number of wrapper convolutions, whereby the wrapper overlap can be crimped over the inner headers placed abutting the roll ends. Alternatively, the wrapper can be wrapped first, followed by insertion of the inner headers into the tubes formed by the wrapper overlap at the roll ends. Next, the wrapper rims are crimped against the roll end, and the outer header is attached onto the crimped wrapper rim and the underlying inner header using conventional hot-melt glueing. Generally, the inner header is made from a relatively thick material thus offering protection to the roll end from mechanical damage. The outer header in turn is made from a thinner material used to bind the wrapper at the roll end and to protect the roll against moisture. Frequently, the colors and pattern printed on the outer header aim at a neat look of the wrapped roll.

A plurality of methods can be used for placing headers onto the roll ends. Manual placing is the oldest technique and it is still suitable for use on packaging lines of relatively modest capacity or in applications manageable without a major need of improving the degree of automation. Herein, the operator simply manually places the inner headers to the roll ends and, positions the outer headers on heatable press platens which attach the outer headers to the roll ends. During the crimping of the wrapper overlap, the inner headers are held by means of separate support arms abutting the roll ends. A vacuum suction is used in turn to keep the outer headers in place on the press platens.

Various designs of automatic header inserters based on different approaches have been used in the art for quite a long time. Common to almost all automatic inserters is that the inserter equipment incorporates for either end of the roll a manipulator device equipped with a grabber capable of transferring the header from a header stack to the roll end. Movably mounted on a vertical guide, a prior-art header inserter has a rotatable arm with a vacuum grabber at its distal end for grasping the headers. Such a header inserter is generally used so that it is adapted to cooperate with different types of header storage shelves located close to the header inserter. By means of this equipment, headers are placed on the roll ends so that the picker arm is first moved along the vertical guide to the height of the shelf containing the stack of desired size headers. Next, the picker arm and the grabber are rotated until the grabber is located parallel to the stack top on the shelf, after which the desired header is picked from the stack and, by rotationally moving the grabber and the arm as well as sliding the same along the vertical guide, transferred to the roll end.

In another system, the headers are placed in stacks on the plant floor and transferred therefrom to the roll ends by means of portal header manipulators. The portal-type transfer manipulator is mounted above the header stacks and the header inserters are generally positioned on the same transferrable crosswise spanned beam. Hence, a separate stack or stacks of each size of headers must be provided for the grabber.

In U.S. Pat. Nos. 4,744,198 and 4,840,008 are disclosed a system for inserting headers where the rolls are first wrapped with a wrapper prior to the insertion of the inner headers. In this system, the headers of different sizes are placed in stacks on tilted shelves. In front of the shelves is a positioning platen movable in the vertical direction. During the fetching of the headers, the positioning platen is elevated to the level of the shelf supporting the desired type of headers and the header is transferred from the shelf stack onto the positioning platen. The locating stops of the platen align the header into its correct position, therefore the header is then moved by means of a pusher to an inserter which in turn pushes the header into a tube formed at the roll end by the wrapper overlap and further fully home against the roll end. As this packaging method requires accurate positioning of the header with respect to the center of the wrapper tube and further against the center of the roll end, the header must be prelocated very precisely prior to its insertion. This prelocation step is performed on said positioning platen and the headers are transferred from said platen along an accurately controlled trajectory to the roll end thus assuring that the prelocation of the header position on the positioning platen corresponds to the desired inserted position of the header on the roll end. Further, as the roll diameters may vary widely, the header inserter device performing the transfer of the headers to the roll ends must have a design compatible with headers of different sizes. In the equipment disclosed in the above-cited patents, this requirement is implemented so that the header inserter has a number of suction cups, of which at least some can be moved into a different position with respect to the other suction cups. In this manner, the headers may be grabbed always sufficiently close to their edges, thus protecting the headers against folding during the placement of the header against the roll end, and moreover, the header inserter can be adapted to fit into the end cavities of the wrapper tube also with smaller-diameter header sizes.

In the above-described, the header inserters are located at both ends of the roll so that the inserters are aligned coaxially with the roll and adapted to move linearly along the center axis of the roll. This arrangement may cause functional disturbances especially in conjunction with thin wrappers. In some situations, the wrapper may sag under its own weight slightly downward, whereby the cross-sectional shape of the tubular cavity formed by the wrapper overlap deviates from the circular shape of the roll outer diameter. As a result, the header edge may hit the wrapper during insertion, thus damaging both the wrapper and header. In order to avoid damages, the function of the equipment must be monitored carefully, and in malfunction situations, the equipment must be stopped and the headers must be placed manually after the wrapper rim is straightened. The header inserter structure becomes rather complicated with the movable suction cups, which require separate mechanisms for moving the suction cups both radially relative to each other and axially with respect to the roll end. This construction is not suited for use in packaging systems in which the roll is rolled into the header inserter station and away therefrom from the side of the station, because the roll cannot obviously be transferred to the station in the direction of the longitudinal axis of the roll. Hence, this type of header inserter station requires a large footprint and restricts the modifiability of the packaging system for use in different applications.

SUMMARY OF THE INVENTION

It is an object of the present invention to provide a method and apparatus for placing headers onto the ends of a roll and into a wrapper tube in more uncomplicated manner and using a simpler apparatus than those available in the prior art.

The goal of the present invention is achieved by virtue of flipping the header during insertion into the wrapper tube by means of a manipulator which is adapted to be rotatable about a shaft offset from the longitudinal axis of the roll, whereby the header is made to advance into the wrapper tube in a tilted position with the first edge of the header entering first.

In accordance with the present invention, a header is transferred into the wrapper tube by means of rotating a header inserter grabber about a shaft. The shaft is offset from the transfer path of the roll and is aligned orthogonal to the longitudinal axis of the roll. The header is made to advance into the wrapper tube in a tilted orientation so that the first edge of the header enters the wrapper tube before the entry of the trailing edge of the header into the wrapper tube.

The present invention offers significant benefits.

When the header is advanced in a tilted position into the wrapper tube, the air pushed ahead of the header is first forced into the wrapper tube cavity and is subsequently displaced therefrom over the edge of the tilted header entering the wrapper tube. Thus, the escaping air helps push the wrapper tube open and the header can be pushed easily home against the roll end without being hindered by a possibly sagging rim of the wrapper tube. In the present invention, the suction cup assembly used in the above-cited U.S. patents is replaced with an assembly in which the suction cups grabbing the header are moved to different heights according to the header size and the lower edge of the header is supported by fixed pushers.

One of the design features facilitating this kind of inserter construction is the above-described arrangement for the transfer of the tilted header to the end of the roll inasmuch as the embodiment according to the present invention manages grabbing of the header with less force. As the header is rotated against the roll end from the side of the roll, the rolls can be transferred to the header inserter station by means of a conveyor operating in the direction of the longitudinal axis of the roll. Generally, this type of header inserter station requires a smaller footprint than a station into which the rolls are present transferred by rolling. The embodiment according to the invention may also be used with packaging systems in which the roll is transferred to the station by rolling, whereby greater liberty is offered by virtue of the present invention in the design of the packaging system according to the available plant space.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the drawings, wherein like reference numerals delineate similar elements throughout the several views:

FIG. 4 shows an enlarged view of the apparatus shown in FIG. 2;

DETAILED DESCRIPTION OF THE PRESENTLY PREFERRED EMBODIMENTS

Figure 1:
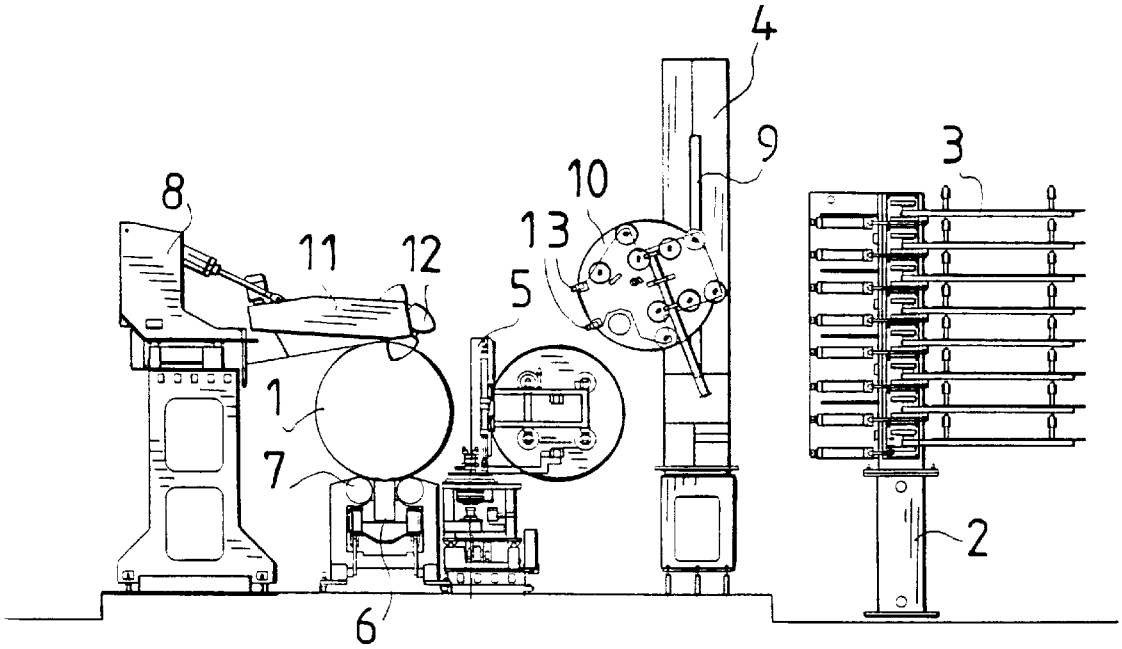
FIG. 1 shows a side view of a header inserter station according to the present invention.
Figure 2:
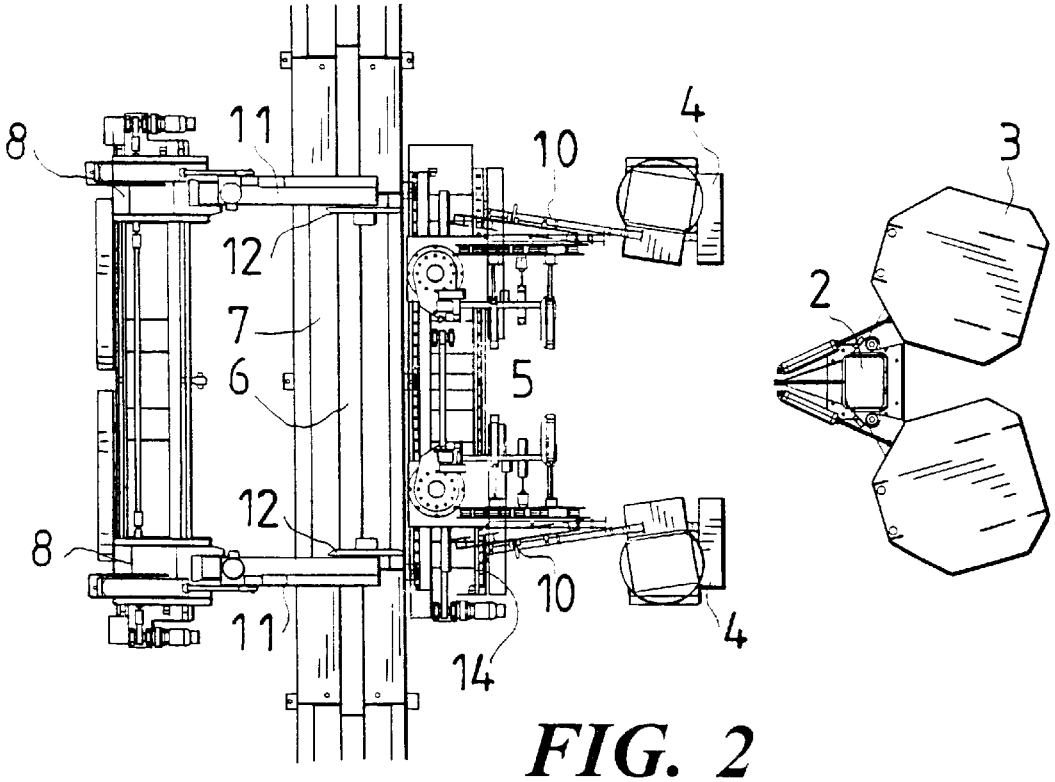
FIG. 2 shows a top view of a header inserter station according to the present invention.
Figure 3:
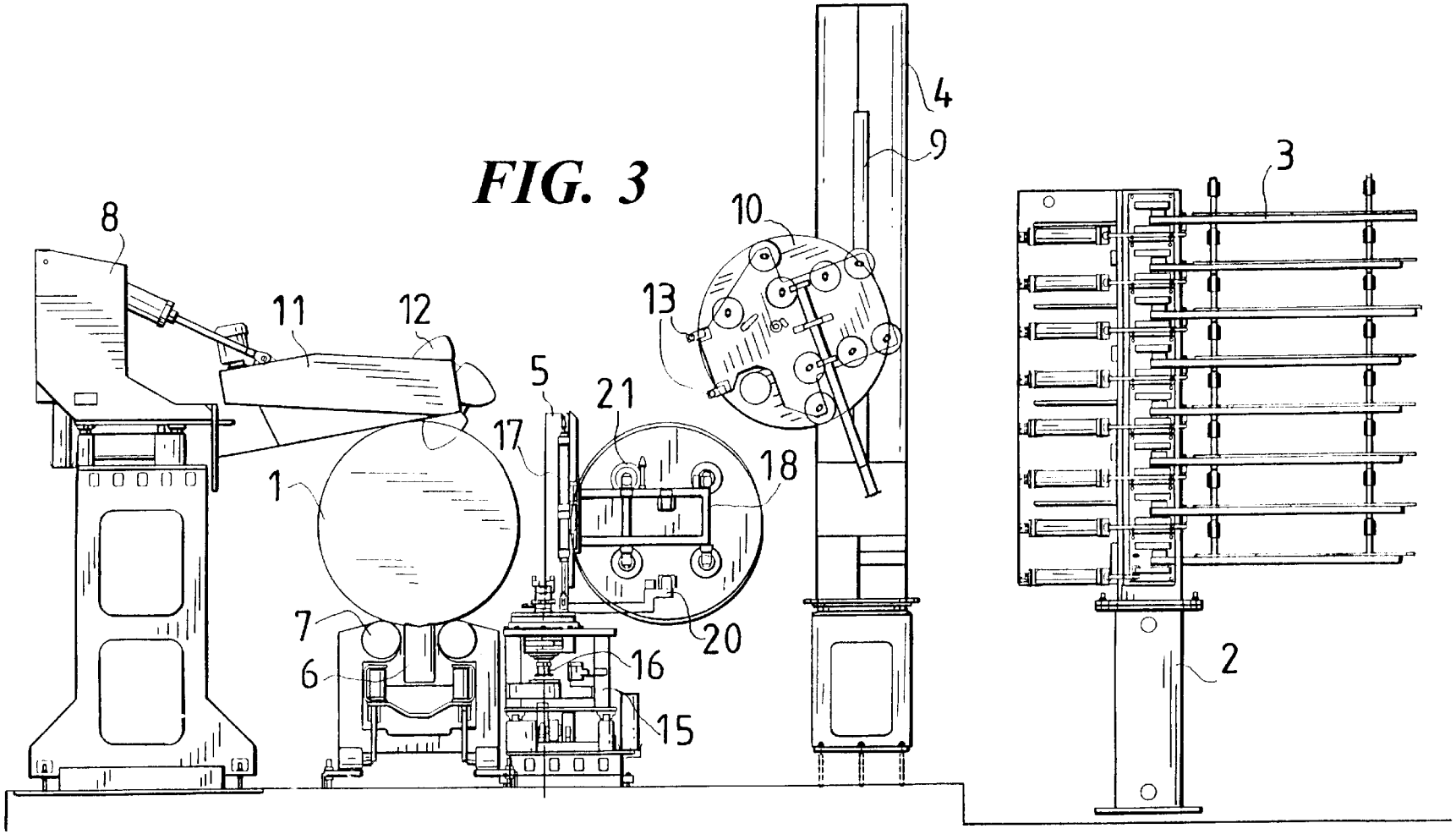
FIG. 3 shows an enlarged view of the apparatus shown in FIG. 1.

Referring to FIGS. 1–4, therein is shown a apparatus for placing inner headers against the ends of a roll 1 to be packaged and crimping the wrapper rims against the roll ends. The apparatus further includes a header storage rack 2 with a number of rotatable header shelves 3 for storing headers of different sizes, a transfer device 4 for moving headers from the header shelves 3 to a header inserter assembly 5. The inserter assembly 5 is used to place the headers onto the ends of the roll 1. A support roller set 7, a conveyor 6 and a crimping device 8 are used for crimping the overlapping rims of the wrapper of the roll 1. As either end of the roll is provided with a separate set of header inserter and wrapper crimping devices, in the following text it is sufficient to describe the function of devices at one end of the roll only. The devices of the opposite end of the roll are mirrored from those discussed below.

The transfer device 4 has a vertical guide 9 along which is adapted to move a suction head 10 which is mounted on a rotatable arm and has a plurality of suction cups for grabbing the headers. The suction head 10 is provided with two positioning stops 13 for the location of headers. The support roller set 7 is formed by two rollers onto which the roll 1 can be lowered and on which the roll can be rotated during the crimping of the wrapper overlap. In this embodiment, the roll 1 is transferred by means of a stepper conveyor 6, whereby the rolls 1 stay all the time on the conveyor and they are not transferred by rolling sideways in the header inserter station. The wrapper crimping device 8 has an elevatable arm 11 which has its distal end a crimping wheel of pleating vanes 12 whose rotational movement effects the crimping of the wrapper overlap against the roll end.

Figure 5:
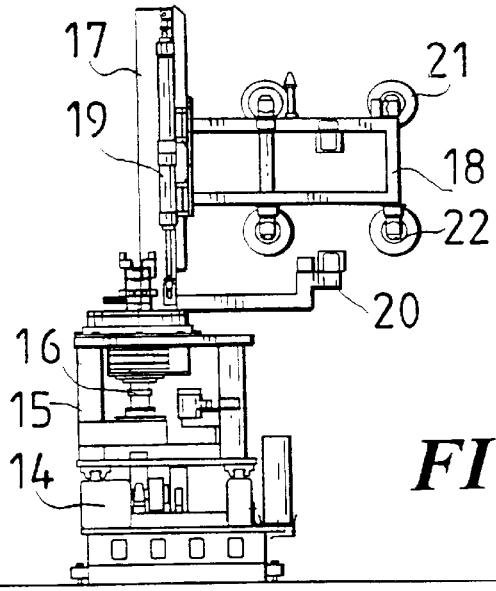
FIG. 5 shows the side view of a header inserter assembly according to the present invention.
Figure 6:
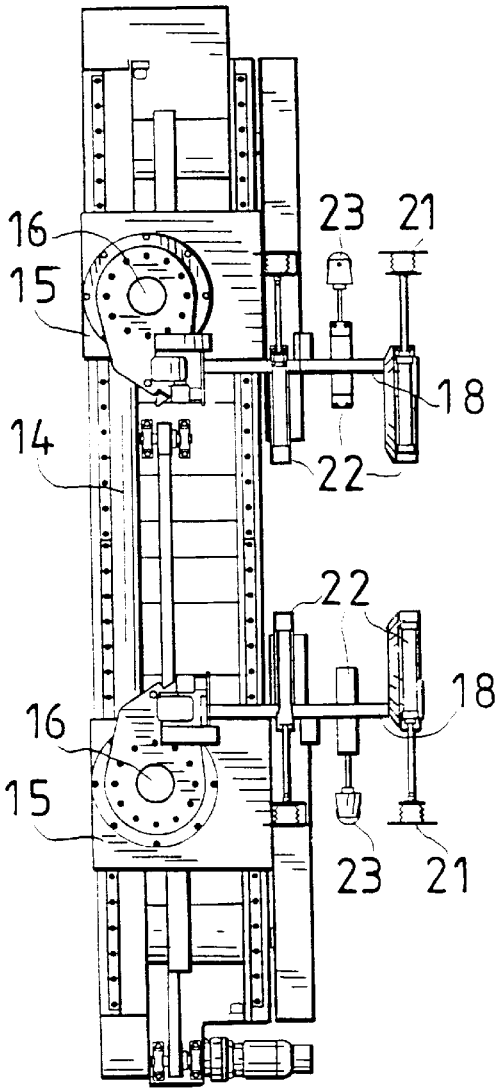
FIG. 6 shows a top view of the apparatus shown in FIG. 5.

In the system according to the present invention, headers are delivered from the suction head 10 of the transfer device 4 to the header inserter assembly 5, whose detailed construction is illustrated in FIGS. 5 and 6. The header inserter assembly 5 comprises a frame 15 which is adapted movable along guides 14 at the side of the support roll set and has a vertical shaft 16 mounted thereto. Onto the shaft 16 are mounted the actual header manipulator means, later called the header inserter grabber, which in the illustrated embodiment comprises a vertical auxiliary frame 17, a backing pusher 20 mounted at a fixed height on said auxiliary frame and a suction cup assembly 18 which is movable in the vertical direction by means of a pneumatic cylinder 19. In the illustrated embodiment, the suction cup assembly 18 comprises four suction cups 21, whose mutual distance from each other is selected so that the smallest header to be manipulated can cover all the suction cups 21, whereby the entire assembly can be inserted even with the smallest practical roll sizes into the tubular cavity formed by the wrapper overlap. The backing pusher 20 at the fixed height and the suction cups 21 are supported by horizontal pneumatic cylinders 22. The position of the backing pusher 20 is selected such that the roller 23 of the backing pusher is located close to the lower edge of the header selected by the header inserter assembly 5. The height of the suction cup assembly 18 is adjusted by means of the pneumatic cylinder 19 so that the suction cups 21 of the assembly 18 can grab the headers at the upper edge while the backing pusher 20 supports the lower edge of the header during its transfer. The header inserter grabber 17–23 is 180° rotatable about the shaft 16, thus allowing the grabber with the header to be turned from its picking position beside the roll to its inserting position at the end of the roll 1.

In the apparatus according to the present invention, the insertion of the inner header occurs as follows.

When the roll 1 to be packed enters the header inserter station, the system is informed of the size of the roll 1 and the header support shelf 3 of the header rack 2 containing headers of the proper size is rotated out. The roll 1 may be received to the header inserter station from a wrapping station, whereby the roll is already within the wrapper, but more advantageously in terms of the available footprint utilization, the wrapping operation is performed when the roll rests on the live support rollers 7 of the header inserter system, whereby the wrapper dispensing means are placed on the same side of the conveyor 6 with the wrapper crimping device 8. If the wrapping is performed in the same station with the header insertion, the wrapper is wrapped first, followed by the insertion of the headers and crimping of the wrapper overlap.

After the wrapper is placed about the roll and the proper header shelf 3 is rotated out, the suction head 10 of the transfer device 4 is actuated to pick the header from the horizontal shelf 3 and the suction head 10 is moved in front of the header inserter grabber 17–23 of the header inserter assembly 5 waiting in its header fetch position. During the transfer movement, the suction head 10 is rotated from its horizontal position into a vertical position. The delivery of the header to the header inserter grabber 17–23 is easiest to understand from FIG. 4, where the suction head 10 drawn in a solid line is shown returning from header delivery and the suction head 10 drawn in a dashed line, together with the grabbed header 24, is shown in its delivery position. The delivery of the header 24 to the header inserter grabber takes place so that the vacuum applied to the suction cups of the suction head 10 of the transfer device 4 is switched off, whereby the header 24 is lowered onto the positioning stops 13 of the suction head. In this position, the header 24 is supported by the suction head and the header inserter grabber 17–23, and additionally, the suction head 10 and the grabber 17–23 are controlled into an accurately known position. Thus, when the header 24 is lowered onto the positioning stops 13 of the suction head, its position will be determined precisely in relation to the header inserter grabber 17–23. Then, for any size of header, the backing pusher 20 is located at a constant, accurately known height, and the adaptation of the grabber for headers of different sizes occurs by moving the suction cup assembly 18, 21, 22 in the vertical direction.

After the header 24 is lowered from the suction head 10 onto the positioning stops 13, it is grabbed by the suction cups 21 of the header inserter grabber. When the header 24 is securely in place on the grabber, the header inserter assembly 5 is moved as necessary on the guides 14 into a proper position determined by the roll length, whereafter the auxiliary frame 17 of the header inserter assembly 5 with the grabber is rotated 180° toward the roll about the shaft 16. As soon as the header 24 closes the tubular cavity formed by the wrapper overlap at the end of the roll 1, the header edge closer to the shaft 16 enters first the wrapper tube. Then, the air moving in front of the header escapes via the gaps remaining between the header edges and the wrapper tube, simultaneously expanding the wrapper tube in the radial direction with regard to the roll 1, thus allowing the tilted header 24 to readily enter the wrapper tube at the same time the header is being rotated upright. The rotational movement is stopped when the header is aligned parallel to the roll end and the header is pushed against the roll end by moving the frame 15 forward. In some cases, e.g., if the wrapper extends only slightly over the roll end, the header can be inserted by a direct rotational movement against the roll end. The header inserter grabber 17–23 must always be rotated over a constant trajectory to make the aligned header enter the wrapper tube and meet the roll end without a collision on its way. Next, the suction cups 21 are detached from the header and the roll is rotated on the support rollers 7 and the wrapper overlaps are crimped by means of the crimping device 8 against the roll end. At least in the initial stage of crimping step, the header can be held against the roll end by pressing the header with the help of the rolls 23 of the backing pushers.

In addition to those described above, the present invention may have alternative embodiments.

While the shaft of the header inserter assembly is advantageously mounted in a vertical position, an equivalent function may also be achieved by using an inclined shaft. However, then the placement of the headers onto the positioning stops may become more complicated and the supporting of the header will be difficult, particularly if the headers are made of flexible materials. The header transfer devices are naturally capable of taking the header even onto a tilted header inserter grabber. However, the rotational shaft must be located aside from the roll transfer path and aligned at least in some plane orthogonal to the longitudinal axis of the roll. Obviously, the mechanical construction of the different devices in the system may be varied widely; for instance, the number of backing pushers and suction cups in the header inserter assembly 5 may be different from those shown in the drawings. In particular, the implementation of the header shelves, transfer devices and crimping means may be varied from those shown, and, for instance, the header transfer devices may be replaced with the portal-type transporters cited above or by articulated robots. The angle of the rotational inserter grabber movement may be varied if necessary due to location of auxiliary equipment or layout arrangements. The header inserter grabber may also be provided with a mechanism which pushes an edge other than that closest to the rotational shaft first into the wrapper tube, but this makes the header inserter construction more complicated. While the stops performing the positioning of the headers in principle might be alternatively mounted on the header inserter grabber, this arrangement would require them to be movable in order to prevent them from hitting the wrapper edge during the insertion of the header into the wrapper tube. In fact, the positioning stops may be omitted if the header transfer device is provided, for instance, with a facility of header position determination and correction by means of photocells or other suitable measurement means.

Thus, while there have been shown and described and pointed out fundamental novel features of the present invention as applied to preferred embodiments thereof, it will be understood that various omissions and substitutions and changes in the form and details of the devices illustrated, and in their operation, may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

I claim:

1. A method for placing headers onto an end of a paper or paperboard roll being packaged comprising:

wrapping a paper or paperboard roll to be packaged about a circumference thereof with a wrapper so that a tubular cavity is formed at an end of the roll by an overlapping rim portion of the wrapper;

selecting and removing a header from a station at which headers are stored;

delivering the selected header to a header inserter grabber which grasps the selected header; and transferring the selected header with the header inserter grabber onto the end of the wrapped roll by rotating the header inserter grabber about a shaft which is aligned orthogonal to a longitudinal axis of the roll so that the header advances into the tubular cavity in a tilted orientation so that a first portion of the header enters the cavity before entry of other portions of the header.

2. The method of claim 1, wherein the first portion of the header is a portion of the header closest to the shaft.

3. The method of claim 1, wherein the shaft is vertically oriented.

4. The method of claim 1, wherein delivering of the selected header to the header inserter grabber is accomplished by the steps of grasping the selected header with a suction head, positioning the header inserter grabber and the suction head grasping the selected header in proximity to one another, and releasing the selected header by the suction head to allow the selected header to lower onto a positioning stop into a preselected position relative to the header inserter grabber.

5. The method of claim 4, wherein the positioning stop is mounted on the suction head.

6. The method of claim 1, wherein the selected header is delivered to a preselected position for grasping by the header inserter grabber, the preselected position being substantially identical for any size of the selected header and for any size of the roll.

7. The method of claim 6, wherein the header inserter grabber transfers the selected header from the preselected position along a trajectory that is substantially identical for any size of the selected header and for any size of the roll.

8. The method of claim 1, wherein the header inserter grabber grasps the selected head with a suction cup assembly.

9. The method of claim 8, wherein the header inserter is transferred onto the end of the roll with the aid of a backing pusher which rotates about the shaft.

10. The method of claim 9, wherein the backing pusher rotates about the shaft as the header inserter grabber rotates about the shaft when transferring the selected header onto the end of the roll.

11. The method of claim 10, further comprising adjusting a distance between the suction cup assembly and the backing pusher as necessary in accordance with a size of the selected header.

12. An apparatus for placing headers onto an end of a paper or paperboard roll being packaged comprising:

a header pickup and transfer assembly for selecting and removing a selected header from a station at which headers are stored and for delivering the selected header to a delivery position; and a header inserter assembly for grasping the selected header at the delivery position and for transferring the selected header onto the end of a roll wrapped with a wrapper so that a tubular cavity is formed at an end of the roll by an overlapping rim portion of the wrapper, the header inserter assembly comprising a header inserter grabber for grasping the selected header at the delivery position, the header inserter grabber being rotatable about a shaft from the delivery position to the end of the roll, the shaft being aligned orthogonal to a longitudinal axis of the roll, so that upon rotation of the header inserter grabber about the shaft the header advances into the tubular cavity in a tilted orientation so that a first portion of the header enters the cavity before entry of other portions of the header.

13. The apparatus of claim 12, wherein said shaft is vertically oriented.

14. The apparatus of claim 12, wherein said header pickup and transfer assembly comprises a suction head for grasping the selected header.

15. The apparatus of claim 14, wherein said header pickup and transfer assembly comprises a positioning stop for use in positioning the selected header prior to transfer of the selected header to said header inserter grabber.

16. The apparatus of claim 12, wherein said header inserter grabber comprises a suction cup assembly for grasping the selected header.

17. The apparatus of claim 16, further comprising a backing pusher rotatable about the shaft for aiding in transferring the selected header onto the end of the roll.

18. The apparatus of claim 17, further comprising a means for adjusting a distance between the suction cup assembly and the backing pusher as necessary in accordance with a size of the selected header.

* * * * *